US009233783B2

(12) United States Patent
Bell et al.

(10) Patent No.: US 9,233,783 B2
(45) Date of Patent: Jan. 12, 2016

(54) LEAK-RESISTANT LIQUID APPLICATOR

(71) Applicants: James Bell, Eastchester, NY (US); Scott Bell, Stamford, NY (US)

(72) Inventors: James Bell, Eastchester, NY (US); Scott Bell, Stamford, NY (US)

(73) Assignee: Dab-O-Matic Holdings Company, Mount Vernon, NY (US)

( * ) Notice: Subject to any disclaimer, the term of this patent is extended or adjusted under 35 U.S.C. 154(b) by 0 days.

(21) Appl. No.: 14/492,236

(22) Filed: Sep. 22, 2014

(65) Prior Publication Data

US 2015/0144658 A1 May 28, 2015

Related U.S. Application Data

(60) Provisional application No. 61/909,130, filed on Nov. 26, 2013.

(51) Int. Cl.

| | |
|---|---|
| ***B65D 47/24*** | (2006.01) |
| ***B65D 50/00*** | (2006.01) |
| ***A45D 34/04*** | (2006.01) |
| ***B65D 47/44*** | (2006.01) |

(52) U.S. Cl.

CPC ..... *B65D 47/242* (2013.01); *A45D 34/04* (2013.01); *B65D 47/44* (2013.01); *B65D 50/00* (2013.01)

(58) Field of Classification Search

CPC .... B65D 47/242; B65D 47/243; B65D 47/44; B65D 50/00; B65D 47/42; A45D 34/04; B43K 5/1845; F16K 1/42

See application file for complete search history.

(56) References Cited

U.S. PATENT DOCUMENTS

| | | | | |
|---|---|---|---|---|
| 3,169,267 A * | 2/1965 | Luedtke | A47L 23/05 222/518 |
| 4,133,614 A * | 1/1979 | Baginski | B65D 47/42 29/448 |
| 5,120,148 A * | 6/1992 | Waters | G01F 11/286 222/207 |
| 5,899,624 A * | 5/1999 | Thompson | B43K 5/1845 401/196 |

* cited by examiner

*Primary Examiner* — David Walczak
(74) *Attorney, Agent, or Firm* — Cozen O'Connor

(57) ABSTRACT

A stored liquid dispensing applicator includes a valving arrangement formed of a valve seat and a spring-driven shuttle that is disposed for axial displacement into and out of valve-defining abutment and engagement with the valve seat. The shuttle is displaceable between distal and proximal limits of travel that include a first position defining the distal limit and a second position proximally spaced from the distal limit and distally spaced from the proximal limit. The valve seat is arranged for contact with the shuttle uninterruptedly between the first and second positions to close the valve, and for spaced apart relation with the shuttle between the second position and the proximal limit of travel to open the valve for dispensing of stored liquid.

10 Claims, 5 Drawing Sheets

LEAK-RESISTANT LIQUID APPLICATOR

RELATED APPLICATION

This application claims priority from U.S. Provisional Patent Application Ser. No. 61/909,130 which was filed on Nov. 26, 2013.

BACKGROUND OF THE INVENTION

1. Field of the Invention

The present invention generally relates to the field of liquid dispensers or applicators and, more particularly, to user-operable applicators that are configured to selectively dispense a liquid—of virtually any viscosity, including creams—from a storage reservoir and which exhibit particular resistance to leakage or other unintended discharges of stored liquid during periods of non-use, including shipping and transport from the manufacturing site to an ultimate purchaser or end-user.

2. Description of Related Art

Liquid dispensers and dispensing applicators are ubiquitous in the market place of today, providing an inexpensive and easily used vehicle for supplying a wide range of liquid-based products to the public. A common feature of such dispensers and applicators is the ability for the user to selectively effect a release or discharge of a typically internally-stored liquid through user-activation of a valving arrangement, commonly into a user's hand (for further transfer to another article or surface) or directly onto the intended surface or workpiece. Automatic closure of the valving arrangement, when the required user-activation effort has ended, to halt and prevent further unintended release of the stored liquid, is an attractive and, in some cases, important element of the functionality provided by such devices.

It will be appreciated that the usefulness and practicality of such liquid applicators and dispensers is significantly dependent on the ability of the valving arrangement to create and maintain an effect closure or seal against the release or leakage of stored liquid during times of nonuse. Many valving arrangements are spring-based closures in which a user-supplied force is applied against the spring to open the valve, and the return urgency drives the valve elements into a closed state when the user-supplied force is removed. Although a tighter or more leak resistant valve closure can be effected by utilizing a stronger spring, increases in the spring force also disadvantageously require more user-applied force to open the valve for each release of liquid and thus necessitate an unfortunate trade-off between user convenience and operational effectiveness.

A particular issue in avoiding unintended stored liquid releases and leakage in current liquid applicator and dispenser constructions arises during their shipping and transport—i.e., when the manufactured devices are shipped or otherwise transported to the retailer or ultimate end user. It is virtually certain that, at one or multiple points during such transport, the liquid-filled devices will be, at the very least, dropped, jostled and inverted, often resulting in unintended discharges or leakage of the stored liquid as the spring-based valving arrangement closure is unintendedly displaced.

Another cause of post-manufacture leakage arises due to the characteristics of some liquids commonly stored for dispensing from such devices. In their assembly, the final step is typically attachment to the applicator or dispensing assembly—i.e. the "working end" of the device—of a shell or container or the like which contains the liquid that the device is intended to dispense. Attachment (and liquid-tight securement) of the liquid-containing shell to the dispensing assembly, in which the valving arrangement is closed under the return urgency of a spring, often creates an overpressure condition within the liquid storage shell. With especially free-flowing, and volatile, liquids, the elevated pressure in the liquid storage reservoir will often result in releases of liquid through the closed valving arrangement, particularly during transport and most especially where, as is common, the devices are transported by air in low pressure or unpressurized cargo holds which still further increase the relative difference between the elevated pressure in the liquid storage container and the ambient atmosphere.

SUMMARY OF THE INVENTION

It is accordingly a desideratum of the invention to provide an improved liquid dispensing applicator that exhibits particular resistance to unintended leakage of stored liquid during periods of nonuse and, in particular, during shipping and transport from the manufacturer to the ultimate end user, and which additionally provides the ability to release an overpressure condition within the liquid storage container or reservoir at the point of manufacture.

A currently-preferred embodiment of a liquid dispensing applicator constructed in accordance with the present invention includes a housing, a shuttle, a liquid-passage valve member, a spring and a locking feature. The housing defines a housing interior and a longitudinal axis and an inlet proximate an axially proximal end of the housing through which a stored liquid is receivable in the housing interior and an outlet proximate an axially distal end of the housing through which the stored liquid is selectively dispensable from the housing interior. The shuttle is movable axially within the housing between distal and proximal limits of travel that include a first position defining the distal limit and a second position proximally spaced from the distal limit and distally spaced from the proximal limit, the shuttle having a frustoconical control surface. The liquid-passage valve member is provided in the housing interior and is disposed (i) for contact with the shuttle control surface uninterruptedly between said first and second positions of the shuttle to close the housing interior against flow of the stored liquid between the inlet and outlet of the housing in both the first and second positions of the shuttle and (ii) for spaced apart relation to the shuttle control surface between the second position and the proximal limit of travel of the shuttle to define a liquid flow passage through which stored liquid can flow between the inlet and outlet of the housing. The spring extends axially in the housing, between the shuttle and the housing proximate the housing proximal end, for normally urging the shuttle toward the housing distal end with a spring force of a first magnitude selected (i) to normally maintain the shuttle, absent application to the shuttle of an external proximally-directed force, in its second position in which flow of stored liquid from the housing inlet to the housing outlet is prevented by the contact of the liquid-passage control member with the shuttle control surface to close the liquid flow passage, (ii) to accommodate proximally-directed travel of the shuttle against the urgency of the spring from the second position to the proximal limit of travel in response to application to the shuttle of an external proximally-directed force to space apart the valve member and shuttle control surface and thereby open the liquid flow passage to enable flow of stored liquid through the liquid flow passage from the housing inlet to the housing outlet for discharge through the housing outlet, and (iii) to return the shuttle from the proximal limit to the second position and thereby reclose the liquid flow passage when the application to the shuttle of the external proximally-directed force is terminated. Finally, the locking feature is defined on the shuttle control surface for releasable engagement with the valve member at the first position distal limit of travel of the shuttle and is configured to retain its releasable engagement and thereby securely maintain closure of the liquid flow passage until an external proximally-directed force of a second magnitude greater than the first magnitude is applied to the shuttle to release the engagement of the valve member and locking feature and effect proximally-directed travel of the shuttle from the first position distal limit to the second position of the shuttle. The spring force first magnitude is selected to be insufficient for causing the shuttle to move, under the urgency of the spring, distally beyond the second position to the first position for releasable engagement of the valve member and the locking feature, so that the movement of the shuttle member from the second position to the first position can be effected only by application to the shuttle of an external proximally-directed force of the second magnitude.

The liquid dispensing applicator may further include a liquid storage reservoir secured proximate the proximal end of the housing for retaining a supply of liquid for dispensing through the housing distal end.

The liquid dispensing applicator may further include a cover member secured to the housing distal end, the cover member providing an application surface through which liquid dispensed from the housing distal end is selectively applicable to a workpiece. The cover member may include a plurality of bores defined through the cover member through which stored liquid dispensed from the housing distal end travels onto an exterior surface of the cover member for application to a workpiece. The cover member may also include a plurality of lands projecting outwardly from the exterior surface for abutting contact with a workpiece as stored liquid is selectively applied to the workpiece.

The valve member of the liquid dispensing applicator may have an engagement edge, and the locking feature may be implemented as a discontinuity defined about the control surface of the shuttle for releasable engagement of the valve member engagement edge with the discontinuity at the first position distal limit of travel of the shuttle. The valve member engagement edge may have a radially-inwardly extending corner tip for contact with the shuttle control surface in and between the first and second positions of the shuttle. At least one of the valve member engagement edge and the shuttle control surface may be formed of a material that is resiliently deformable in response to engagement of the valve member engagement edge and the shuttle control surface at and proximate the first position of the shuttle. The shuttle control surface may take the form of a first segment having a first radially-varying contour and a second segment having a second radially-varying contour, the discontinuity being defined at an intersection of the first and second segments. Each of the first and second segments of the shuttle control surface may define a frustoconical surface.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

The various features, functions and advantages characterizing the invention will be better understood by reference to the detailed description which follows, taken in conjunction with the accompanying drawings, in which.

DETAILED DESCRIPTION OF THE CURRENTLY PREFERRED EMBODIMENTS

Figure 1:
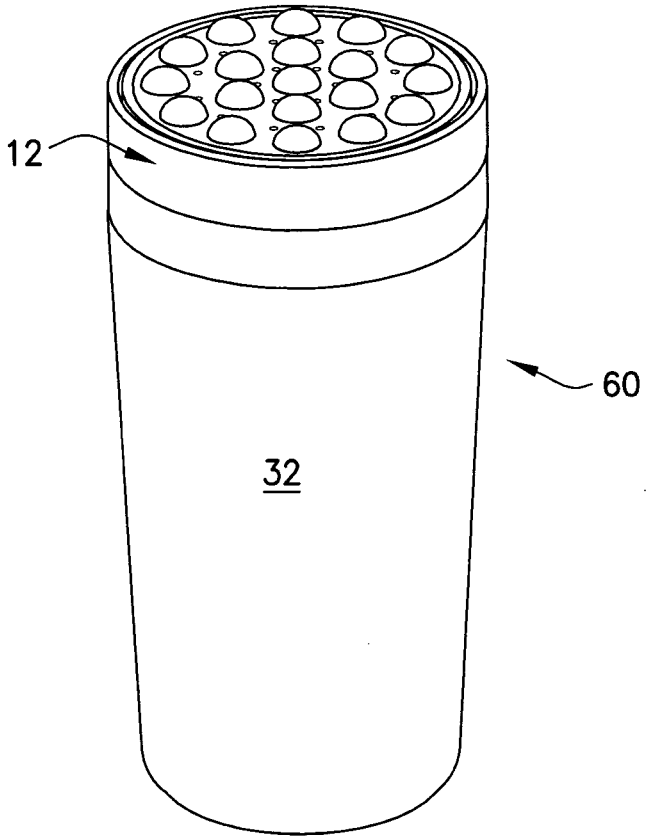
FIG. 1 is an elevated perspective view of an assembled liquid dispenser constructed in accordance with a currently-preferred embodiment of the invention.

A preferred embodiment of a leak resistant (commonly referred to as leak-proof) liquid dispensing applicator 10 constructed in accordance with the present invention as depicted in the figures includes a housing 12 which extends axially between an open distal end that defines a liquid discharge opening 14 and an open proximal end that bounds a liquid intake or receiving opening 16. As used herein, the term "liquid" is intended to mean—and the inventive applicator is useful and can be readily configured to dispense—a flowable substance (that is neither solid nor gas) having a definite volume and no fixed shape, and having any of a wide range of viscosities, including by way of non-limiting example water (at one end of the spectrum) and creams (at the other). It is contemplated that the housing will generally be configured with a generally round or circular cross section, and the illustrated applicator embodiment 10 is so depicted and will be herein so described. Nevertheless, it will be apparent to those skilled in the art, and it is fully intended, that the housing can assume other cross-sectional shapes, such by way of nonlimiting example as oblong or, if desired for a particular application, with a generally rectangular or otherwise multi-sided configuration. Other elements of the applicator 10, as will also be apparent as this description proceeds, may as appropriate or desired be cross-sectionally conformed or otherwise adapted to non-circular (in cross section) implementations of the housing 12, adaptations and modifications which are deemed to be well within the normal design abilities of the skilled artisan. In any event, all such alternate cross-sectional shapes and contouring of the housing 12 should be understood to be within the intended scope and contemplation of the invention, as a general matter of design choice and an intended usage or application.

The housing may be of unitary or integral construction formed, by way of example, through injection molding using a plastic material such as nylon, acetal, polypropylene, polyolefin or other suitable material. The particular materials of which the housing 12 and/or its components are formed is for the most part a matter of design choice based on such factors as, by way of illustration, ease and desired methodology of manufacture, cost, size, the characteristics of the liquid to be dispensed, the market into which the product is to be sold, and preferred ornamental aspects of the resulting article.

A housing sidewall 18 that extends from the intake opening 16 toward the discharge opening 14 terminates distally in a peripheral knob 20. An outer arm 22, formed of a first leg 23 that extends radially outward from the sidewall 18 proximate the housing distal end and a second leg 24 that extends from the radially outer end of the first leg 23 in the direction of the distal end substantially parallel to the sidewall 18, depends from and peripherally about the sidewall 18. The second leg 24 defines at its free end the peripheral bounds of the discharge opening 14 and may there terminate in a lip 25 that extends radially inward toward the housing axis to facilitate its support of a cover member as hereinafter described.

It is intended that the applicator 10 of the present invention will in practice be utilized to selectively, generally under the control of a user, dispense through the discharge opening 14 a liquid which is held or stored in an attached and associated container 32. As depicted by way of example in FIG. 6, the liquid reservoir or storage container may take the form of a hollow bottle or vial or jar or other such receptacle or vessel that is configured as a matter of design choice and is suitable for holding a supply of the liquid to be dispensed. Thus, the container 32 may be of any desired shape or contour, may be rigid or pliant or resiliently flexible, may be selectively opaque or transparent, and may be formed of glass, or plastic, metal or alloy, or any other material as a function of acceptable cost and desired appearance as well as to assure non-reactive holding or storage and ease of dispensing of the particular liquid to be stored in the container 32 and dispensed by the applicator 10, all as general matters of design choice.

The container 32 will in any event have an open (or openable) end 34 (or other suitable dispensing opening) bounded by a portion 36 of the container sidewall or wall or web at which the container is attachable to the applicator 10. It is generally intended and contemplated that, to attach the container to the applicator embodiment herein depicted and described, the container wall portion 36 will be positioned closely or abuttingly nested about the applicator housing sidewall 18—or will have a thickened wall portion 36 relative to the remainder of the container sidewall—so that the end or lip 38 of the container open end 34 abuts the proximal surface of the first leg 23 of the outer arm 22. Thus, as will be appreciated, in certain preferred forms of this arrangement the thickness of the material or web that forms the container sidewall portion 36 will be (at least in the region of wall portion 36) substantially equal to the radially outwardly extending length of the first leg 23 of the outer arm 22 so that the combined container and applicator form a substantially smooth and uninterrupted surface from the lip 24 of the outer arm 22 to and along the container wall portion 36. The contemplated securement of the container wall portion 36 to the applicator sidewall 18 may be implemented using any suitable or otherwise desired method, such as sonic welding or adhesives or mechanical interlocks or fitments or undercuts, as a general manner of design choice and in view of the materials of which the housing sidewall 18 and the container wall portion 36 are formed. Although it is generally anticipated that in commercial implementations of the applicator 10 the applicator and liquid-holding container 32 will generally be permanently secured together, embodiments and applications in which the container 32 is releasably secured to the applicator 10 to enable, for example, selective replacement of an exhausted supply of the liquid to be dispensed by the applicator 10—as by way of non-exclusive illustration through meshed interengagement of mutually-threaded surface portions on the applicator sidewall 18 and the container wall portion 36—is also within the intended scope and contemplation of the invention.

Returning now to the herein-depicted embodiment of the inventive applicator 10, an inner arm 26 extends radially inward from the sidewall 18 closely adjacent to and proximally spaced from the knob 20 to define a peripheral sealing tip 28 configured in a predetermined manner described hereinbelow in conjunction with the figures. Suffice it to say, at this point in the disclosure, that the tip 28—which defines a valve member or seat—cooperates with a specially-configured surface portion of a movable shuttle member 30 of the applicator 10 to form, with the shuttle member surface, a selectively disengageable first-level seal in one position of the shuttle and an enhanced second-level seal in a second position of the shuttle, in each case to prevent the unintended release of stored liquid through the discharge opening 14. In particular, the first-level seal is effective to prevent such liquid release, e.g. leaks or other unintended discharges of stored liquid through the applicator distal end, between normal end user-initiated liquid-release activations of the applicator 10, and the second-level seal is effective, inter alia and by way of illustrative example, to prevent such liquid release during shipment or transport of the applicator 10 and attached liquid container 32—i.e. typically before the applicator 10 and attached liquid storage container 32 is delivered to an end user. Thus, the second level seal is a stronger, more secure seal that is particularly effective to prevent the release, through the discharge end of the applicator, of stored liquid from the container 32 prior to (for example) purchase or distribution of the applicator 10 to an end user—e.g. during shipment or transport.

Figure 2:
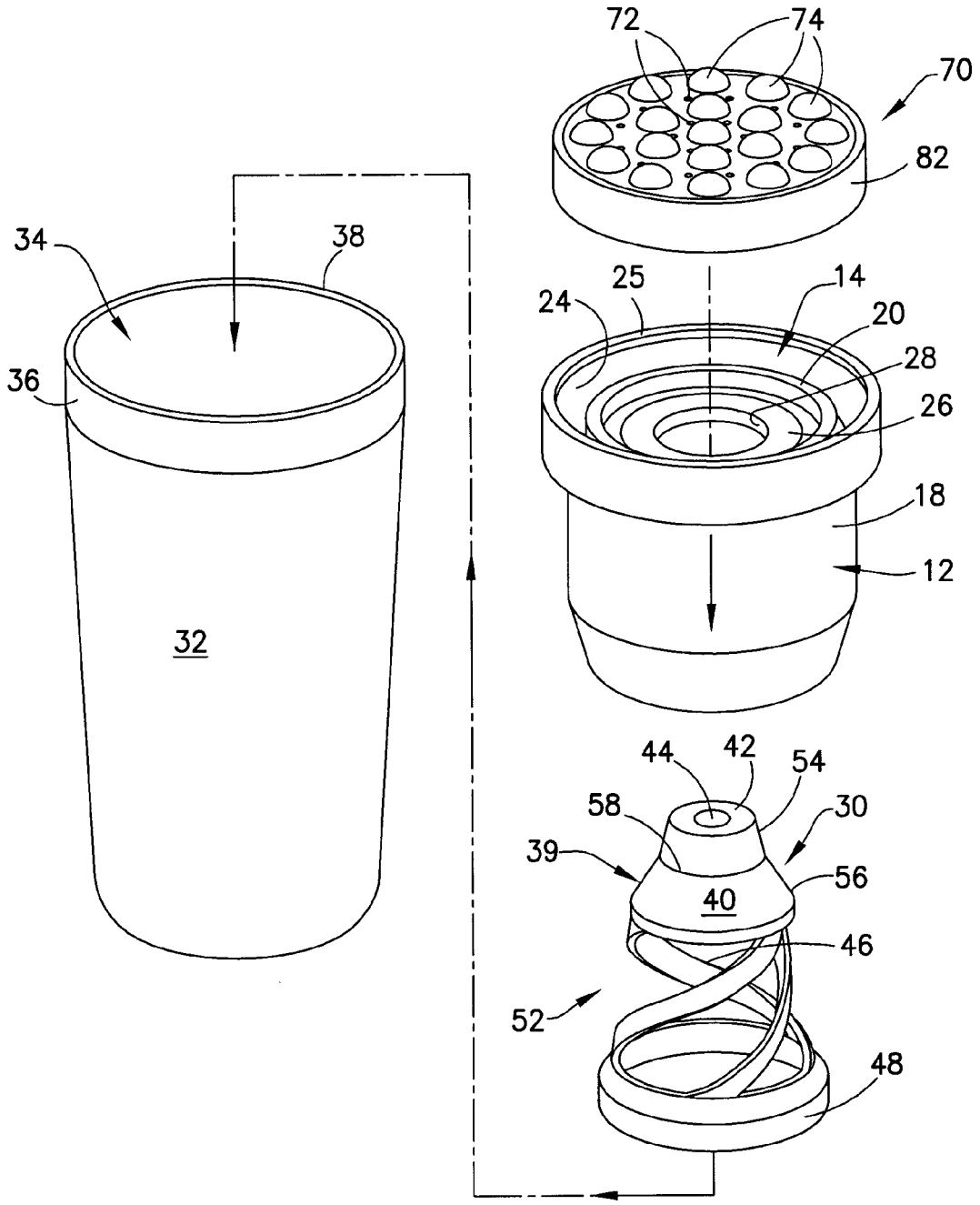
FIG. 2 is an exploded elevated perspective view showing the various parts and elements that form the assembled liquid dispenser of FIG. 1.
Figure 4:
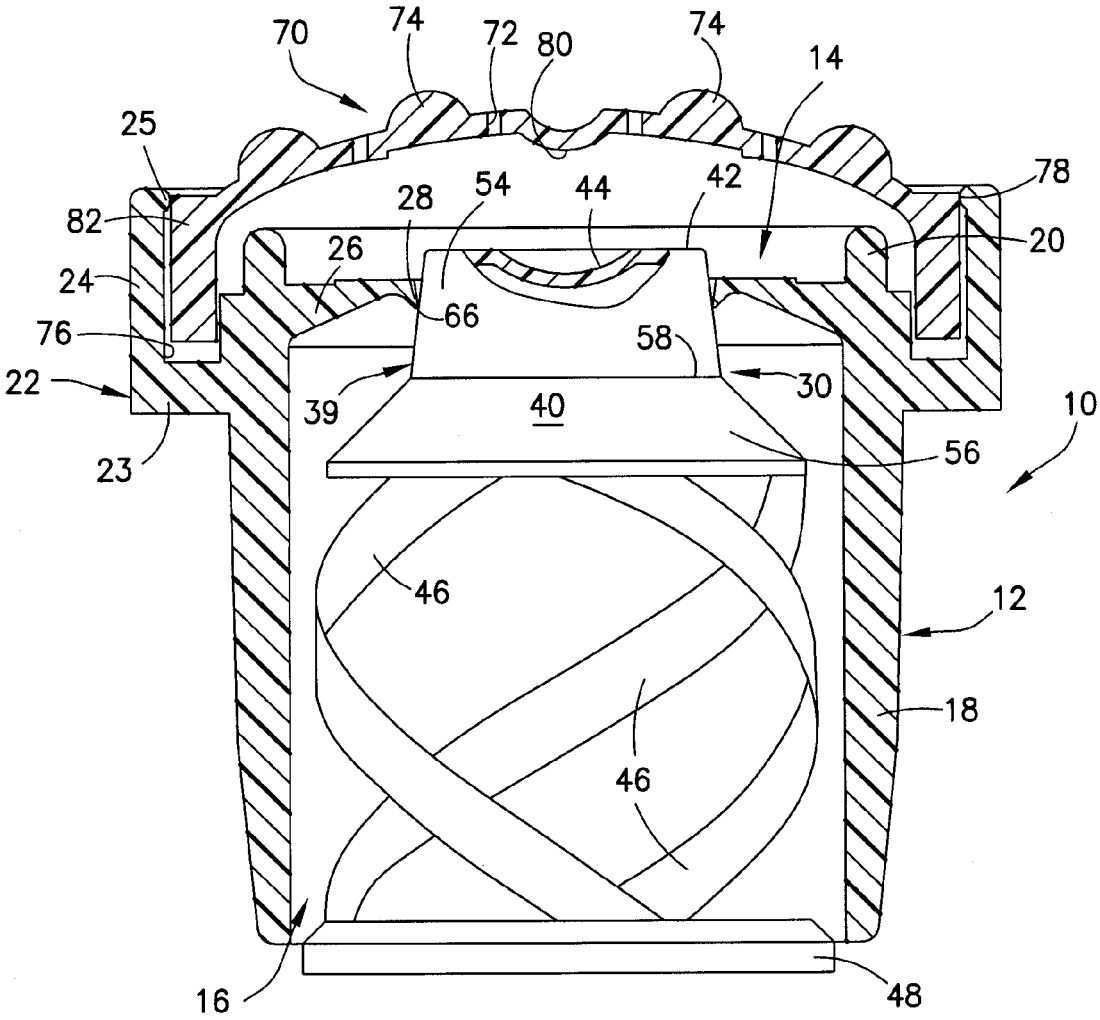
FIG. 4 is a cross-section of a preferred embodiment of the liquid applicator portion of the preferred liquid dispenser showing the shuttle member in its second position of travel.
Figure 5:
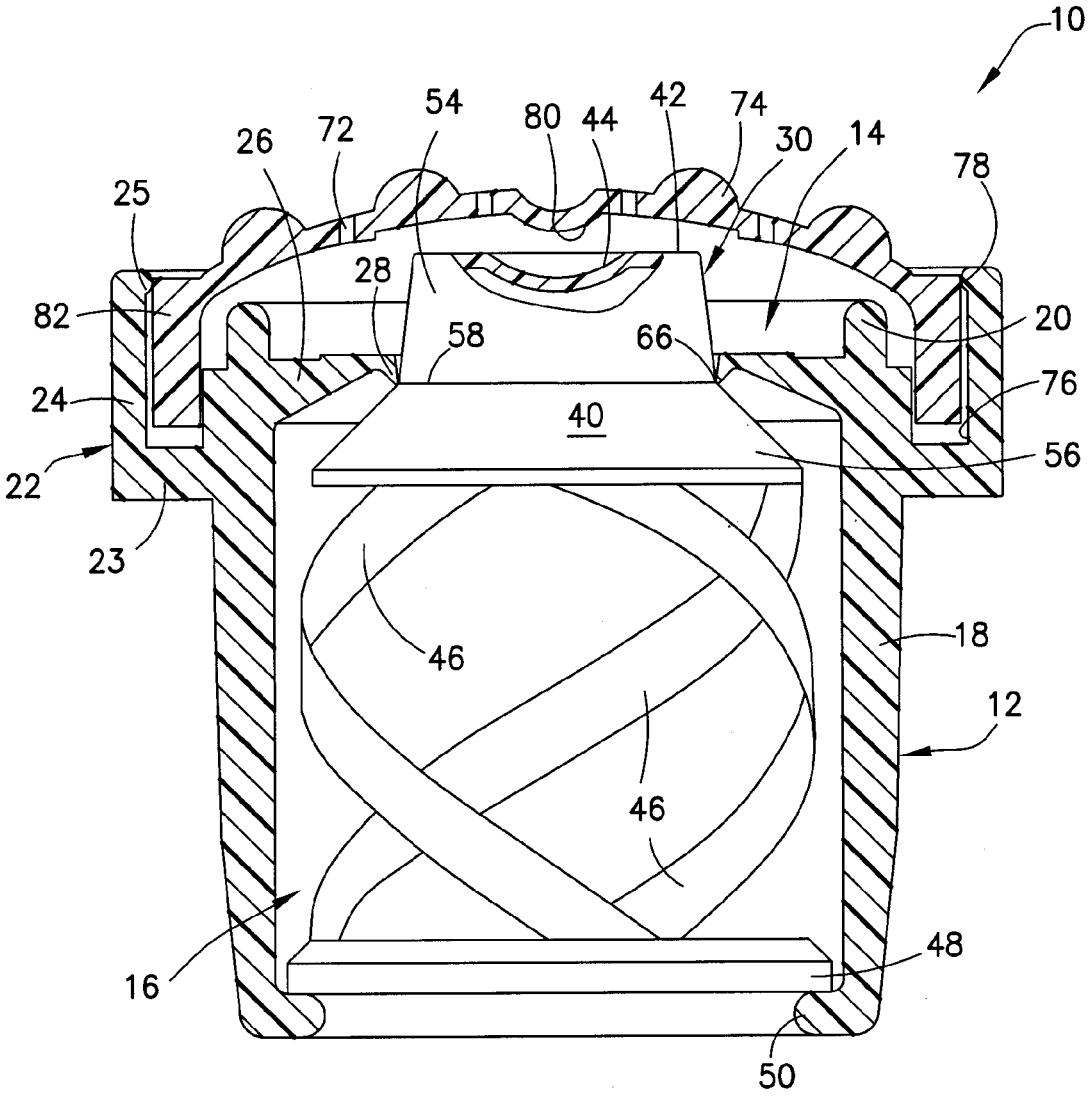
FIG. 5 is a cross-section similar to FIG. 4 in which the shuttle member is shown in its first position of travel.

The shuttle member 30, seen in further detail in FIG. 2, is arranged within the housing 12 for axial movement or displacement between a second position to form the first-level seal and a first position to form the second-level seal. In the depiction of the applicator 10 seen in the figures, the first second position of the shuttle member is shown in FIG. 4 and the first position of the shuttle member is shown in FIG. 5. As is evident in the figures and this description, the shuttle member is a unitary element, the entirety of which is displaceable as a whole along a path of travel that includes its first and second positions.

In its preferred form the shuttle member 30 has a generally frustoconical peripheral sidewall or surface 39 that extends axially from a wider proximal base 40 to a narrower distal top which bounds a top surface 42. The top surface 42 is substantially planar or flat but may, in particular and currently preferred implementations, include an inwardly concave depression or dimple 44 substantially centrally defined on the surface 42. The shuttle member may and will preferably be implemented as a hollow body having an open bottom or base 40 and a closed top surface 42, although embodiments of the shuttle member that are partially or substantially solid throughout (i.e. between its base 40 and top surface 42) are also within the scope and contemplation of the invention. In preferred embodiments of the invention, the shuttle member sidewall 39 is somewhat resiliently flexible, as will hereinafter be clear, although its flexibility vel non (and the degree of flexibility) is primarily a matter of design choice. It is further preferred, as will be apparent as this description proceeds, that the shuttle in the illustrated and described embodiment has a generally circular cross section.

Figure 6:
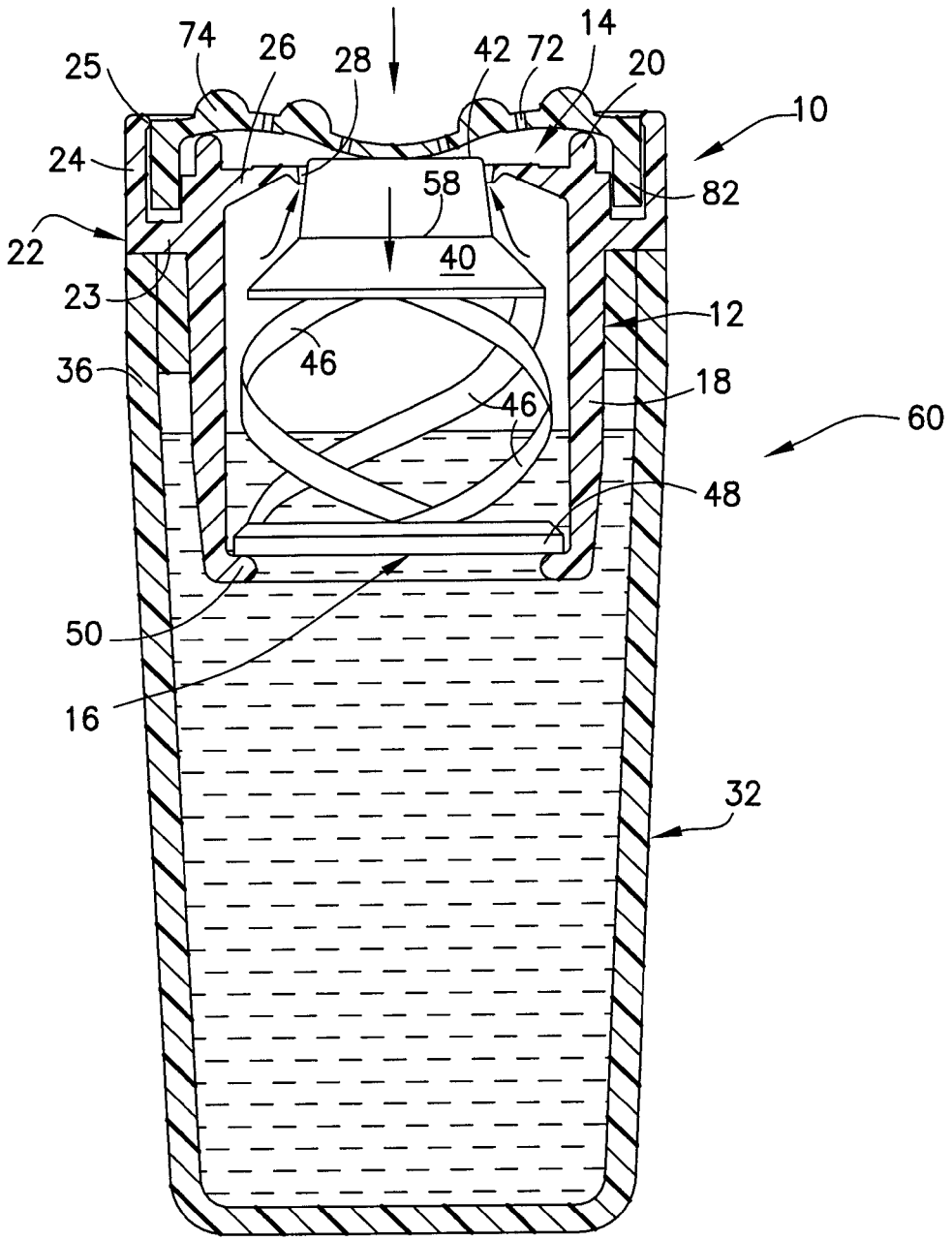
FIG. 6 is a cross-sectional view of the preferred embodiment of the assembled liquid dispenser of FIGS. 1 to 3 in which the shuttle member of the liquid applicator is shown in its liquid dispensing position of travel distally displaced from its FIG. 4 second position.

In the applicator 10, the shuttle member 30 is biased for axial movement toward the distal end of the applicator—i.e. "upward" in FIGS. 4, 5 and 6. In preferred forms of the applicator, the shuttle is resiliently biased by a helical spring 46 that extends between the shuttle member and a foot 48 that is captured within the applicator proximal end and against the bias of the helical spring by a radially inwardly extending lip 50 (FIGS. 5 and 6) that is defined at the proximal end of the housing sidewall 18. The shuttle member 30, helical spring 46 and foot 48 may be unitarily formed as a single, integral operating element 52 in which the foot comprises an open peripheral rim and the spring is implemented by multiple (e.g. three) helical arms that unitarily extend between the periphery of the shuttle base 40 and the foot 48. In this preferred arrangement, the spring 46 and foot 48 bound a substantially open area through which stored liquid from an attached container 32 can unimpededly flow outward from the container open end 34 and through the applicator 10 in the direction of and for user-controlled dispensing from the distal end liquid discharge opening 14 of the applicator, as for example depicted in FIG. 6.

The shuttle member sidewall 39, in conjunction with the tip 28 of the inner arm 26, forms a user-operable valve which is effective to control the releasability, and release, of stored liquid which is dispensable through the distal liquid discharge opening 14 of applicator 10. Thus, as the shuttle member 30 is axially moved along its full extent of travel, the sealing tip 28 rides on and along the sidewall 39 for part of that axial motion to cooperatively define a closed valve that prevents an outflow of stored liquid through the distal discharge opening 14, and is spaced from the sidewall in another part or portion of the extent of axial travel of the shuttle to define an open valve permitting a user-controlled outflow of stored liquid through the applicator opening 14.

Although the shuttle member is generally frustoconical—in at least the sense that its base 40 is wider than the periphery of its top surface 42—in a currently preferred embodiment the sidewall 39 of the shuttle member has a contour (i.e. a radius from its central axis) that increases (from its top to its bottom) in an overall nonlinear fashion. More particularly, the sidewall 39 in the embodiment herein depicted and described is formed of two distinct parts or regions, a first operating segment 54 proximate the distal end and a second segment 56 proximate the proximal end of the shuttle member—each of which segments are generally substantially smoothly continuous—separated by a discontinuity or region of discontinuity 58. Each of the segments 54, 56 may itself have a substantially conical contour (i.e. a generally linearly increasing or decreasing radius) along at least most of its axial extent—although one or both of the segments 54, 56 may alternatively be axially curved or otherwise define a nonlinearly varying radius of the sidewall 39—as a general matter of design choice or to suit a particular application for or desired operating characteristics of the applicator 10, as will hereafter become apparent.

In the currently preferred form of the shuttle sidewall 39 depicted in the figures, the outer wall radius of the shuttle member along at least a portion of the axial extent of each of the first and second segments 54, 56 increases, as one moves from its distal to its proximal end, substantially smoothly and generally linearly, albeit at different rates; mathematically, that is, the first and second segments define different overall slopes along at least most of the axial extent of each. Thus, the first segment 54 has a relatively sharper or more axially angled overall slope, whereas the second segment has a relatively flatter or more gradual overall slope. The discontinuity 58 defines or is located closely proximate an intersection of the first and second segments 54, 56 at which, optionally, the radius of the sidewall 39 may be further reduced from the radius of each of the first and second segments at or adjacent or relatively closely proximate the discontinuity 58, as in the form of a slight dimple or depression that peripherally encircles the shuttle member sidewall. In the particular exemplary embodiment depicted and described herein, the juncture of the first and second segments 54, 56 of the shuttle sidewall defines the discontinuity 58. In any event, the discontinuity provides a location on the sidewall 39 at which the sealing tip 28 on inner arm 26 can be maintained or captured to define the second level seal in the first position of the shuttle member 30 and to impede unintended further axial movement of the shuttle member proximally beyond and disengagedly away from its first position—i.e. the position depicted in FIG. 5 of the drawings.

The configurations and contours of a currently preferred form of the shuttle sidewall discontinuity 58 and of the inner arm sealing tip 28 can be seen in FIGS. 4, 5 and 6. In this arrangement, the surface of the sealing tip disposed in confronting opposition to the shuttle sidewall 39 is formed as a radially-inwardly sloping surface, moving axially from its distal (top, in the figures) to its proximal (bottom) edge; this slope—i.e. the increase in its radially-inward extension—can be linearly constant, or non-linearly variable, as a general matter of design choice. In certain contemplated constructions, the valving end of sealing tip 28 can have two (for example) discrete portions, e.g., a distal first portion or segment oriented generally parallel to the longitudinal axis of the housing 12 and a proximal second portion or segment that extends proximally from the intersection of the first and second portions in a direction slightly radially inward toward the housing axis. In any event, the radially-inward or valving end of the sealing tip 28 terminates at an edge or corner 66 that defines the radially innermost extension of the inner arm 26. With the application of an external, distally-directed force to the shuttle member 39—e.g. to the foot 48 and, through the spring 46, to the shuttle member—the shuttle member is distally axially displaced beyond the second position (FIG. 4) into the first position (FIG. 5) in which the inner arm corner 66 is retained in engagement with the discontinuity 58 to form the second level seal. As the shuttle member advances from its second to its first position, inner arm corner 66 rides along and causes resilient deformation of the shuttle sidewall first segment 54 (and/or, in certain other contemplated embodiments, of the inner arm 26 proximate sealing tip 28) until it reaches the discontinuity 58, at which point continued distal displacement of the shuttle is prevented by the radially-outwardly sharper angle or slope of the second sidewall segment 56 that extends proximally from the discontinuity 58. The resulting second level (first position, FIG. 5) seal formed by the inner arm corner 66 disposed in deforming abutment with the discontinuity 58 of the shuttle sidewall can be reversed—i.e. the shuttle can be returned axially proximally to its first level (second position, FIG. 4) seal only by the application of an external, proximally-directed force to the shuttle member, e.g. to or against its top surface 42. Thus, in its second position the shuttle member is disengagedly locked against unintended motion which would allow liquid stored in container 32 to pass between the inner arm 26 and shuttle sidewall 39—i.e. to open the valve that these two elements cooperatively define—and thereby permit any outflow or release of the stored liquid through applicator opening 14.

In other embodiments of the inventive applicator 10, the shuttle sidewall 39 may additionally include, distally closely proximate the intersection or juncture of the first and second segments 54, 56 of sidewall 39, an indentation or cut or groove (not shown) having a contour that, optionally, may substantially complement the slope or the multi-segmented contour of the opposed surface of the sealing tip 28, in any event such that the sealing tip is further receivable in and releaseably engageable with/from such indentation in the first position of shuttle 30. As will be appreciated by those skilled in the art, varying of the location of any such indentation or groove relative to the intersection of the first and second segments 54, 56 of sidewall 39 of the shuttle member will alter the amount of force that must be applied to the shuttle to displace the shuttle away from its first position in which the sealing tip 28 is disposed in captured engagement by or within the indentation; this will permit the applicator to be further customized as a matter of design choice to accommodate, for example, a particular application or use or functionality and/or specific characteristics of the stored liquid to be dispensed. Further embodiments of the applicator in which the sealing tip engagement or valving surface, in optional conjunction with a corresponding shuttle sidewall indentation or groove that defines a discontinuity, is implemented by a single surface segment of the shuttle that is suitably angled or curved or otherwise continuously contoured along its axial extension, are also within the intended scope and contemplation of the invention.

Figure 3:
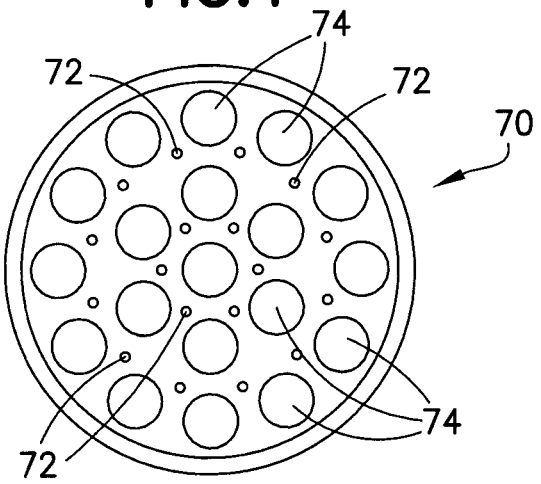
FIG. 3 is a top plan view of the assembled liquid dispenser of FIG. 1.

The final element of the completed applicator 10 is a cover member 70 that is secured to and about the distal end of housing 12. The cover member defines a surface through which stored liquid dispensed from the applicator 10 can be applied to and/or is distributable, typically through contact, onto a workpiece, such by way of nonlimiting example as an artificial substrate or the surface of an end user's skin or nails. The material of construction, the characteristics of the material of construction and of the cover member, and the contouring or surface structures defined on the cover member face, can be selected as general matters of design choice to suit the particular application or function intended for the applicator 10 as well as the formulation, qualities and properties of the stored liquid to be dispensed through the cover member. In one currently-contemplated construction, cover member 70 is formed of a polyolefin or polyurethane or neoprene and exhibits a predetermined or desired degree of flexible resiliency, and (as seen for example in FIGS. 2 and 3) includes a selected plurality of throughbores 72 selectively distributed about its surface and a plurality of selectively-configured lands or knobs 74 that project outwardly from the face of the cover member. The throughbores 72 function to deliver stored liquid that is dispensed from applicator 10 through its discharge opening 14 onto the outer or distal face of cover member 70, and the knobs 74 are positioned and configured to facilitate distributed application of the dispensed liquid onto the workpiece as the cover member face is placed in contact with and against (and, optionally, moved about) the workpiece surface. Where the workpiece surface is, for example, an end user's skin—as where the stored and dispensed liquid is by way of illustration a cream—the knobs 74 can additionally be configured to provide a massaging function as the face of the cover member is placed or pressed against and displaced along and about the surface of the skin to apply the stored cream onto the user's skin.

In the current embodiment, the cover member further includes, centrally projecting from its interior-facing surface, a knob 80. It is intended that the knob 80, in the fully assembled condition of the applicator 10, be substantially aligned, axially, with the depression 44 in the top surface 42 of shuttle member 30. When the cover member is inwardly/proximally deformed or displaced—e.g. through pressed contact with a work surface to which the stored liquid is to be applied—to proximally displace the shuttle member and thereby open the liquid release valve cooperatively defined by the inner arm tip 28 and the shuttle sidewall 39, the knob enters and engages the depression 44. Although the size, i.e. the radial or diametric extent, of the knob 80 is exaggerated in the figures for ease of depiction, it is generally contemplated that the cover member knob will be peripherally smaller and, moreover, smaller than the radial extent of the depression or dimple 44 defined in the top surface 42 of shuttle member 30.

Securement of the cover member 70 to applicator housing 12 is effected by disposing the peripheral region 82 of the cover member into the channel 76 defined between the second leg 24 of outer arm 22 and the distal end of housing sidewall 18. Cover member 70 may also optionally be configured with a notch 78 defined at a location radially-inwardly spaced from its peripheral edge for receipt of lip 25 to thereby assist in proper positioning and retention of cover member 70 on housing 12; alternatively, notch 78 may be omitted such that the lip 24 deformingly engages the cover member to assist its retention. In any event, the cover member may be secured to applicator housing 12 in any desired manner, as for example by sonic welding, although in currently-contemplated embodiments the cover member is swaged to the applicator housing.

It should also be understood that the cover member 70, as herein described and depicted, although an element of the preferred forms of the applicator 10 shown and described in this specification, is not an essential or critical component of the inventive applicator which may be combined or fitted with any suitable part or material through or by which liquid dispensed from the inventive applicator is applied to the desired surface or workpiece or, indeed, in suitable constructions entirely omitted from the ultimately assembled liquid dispenser. This should by now be clear and apparent from the foregoing discussion.

To assemble the illustrated applicator 10 of FIG. 1 from its component parts, the cover member 70 is first swaged or mechanically fitted or otherwise secured to the distal end of housing 12, so that the cover member overlies and envelopes the liquid discharge opening 14.

The operating element 52 is next inserted into the interior of the housing 12 from the proximal end of the housing, by first introducing the shuttle member into the housing. As initially formed—e.g. by injection molding of a suitable heat-curable plastic material that forms a housing of at least limited flexibility—the proximal end of the sidewall 18 does not include the lip 38 so that the operating element 52 can without interference or impediment be fully, readily inserted distally into the housing interior through the liquid intake opening 16. With the operating element fully inserted into the housing interior, so that its foot 48 is disposed distally inward of the proximal end of the housing sidewall 30, that proximal end of housing sidewall 30 is briefly heated or otherwise manipulated to form the lip 38 and thereby capture operating element 52 within the housing interior.

It will be understood and appreciated that insertion of the operating element 52 into the housing interior causes the leading shuttle member to advance distally, against the return urgency of helical spring 46, as the operating element foot 48 is distally inserted. As the shuttle member 30 travels distally into the housing interior, the corner 66 of sealing tip 28 of inner arm 26 initially contacts (FIG. 4) and then rides on and proximally along the first segment 54 of sidewall surface 39 of the advancing shuttle member, until it (and, optionally, the remainder or entirety of the sealing tip engagement surface) finally advances into engagement with the discontinuity 58 of the shuttle sidewall (FIG. 5). The slopes and contours of the first and second segments 54, 56 of the sidewall 39 proximate the discontinuity 58, and the positioning and contours of the sealing tip 28 and indentation 66, are selected to facilitate resistive entry of the sealing tip 28 into captive engagement at or with the discontinuity 58 and to prevent further distal advance of the shuttle member beyond such engagement which defines the first position of travel of the shuttle member. This second and ultimate position of distally-directed travel of the shuttle member, shown in FIG. 5, thus represents the distal-direction limit of axial shuttle member movement in the assembled condition of the applicator 10.

With the operating element 52 captively positioned within the housing interior, the shuttle member releasably disposed in its first position, and cover member 70 secured to the applicator housing, a container 32 of liquid to be selectively dispensed by the applicator 10 is positioned as seen in FIG. 6 and is there secured to the housing sidewall 18 to form the assembled liquid dispenser 60. The engagement of the inner arm tip 28 with the discontinuity 58 defined in the shuttle member sidewall 39 forms a particularly effective second level seal against passage of liquid, initially stored in the container 32, from the housing interior to the distal liquid discharge opening 16 of the applicator 10 for unintended release from the applicator. In particular, in preferred embodiments of the inventive applicator this second level seal is highly effective to prevent leakage or other unintended releases of liquid through the applicator discharge end or opening 16 during, by way of example, shipping and other potentially rough handling or inversions or unusual orientations of the liquid dispenser 60, even in implementations in which the stored liquid is of a highly volatile or other difficult to contain nature. Those skilled in the art will appreciate that formations of the discontinuity 58 which define a depressed or concave dimple may provide particularly advantageous seals at its engagement with the inner sealing tip 28, which may itself be selectively configured in combination with the discontinuity 58 as a general matter of design choice to suitably enhance the resulting so-called second level seal.

When the container 32 is (as described above) positioned for attachment to the housing sidewall 18 of the applicator 10, and is secured thereto, it contains the liquid intended to be incorporated in the fully-assembled and user-deliverable dispenser 60. Those skilled in the art of liquid dispensers of the general class and functionality of the present invention will understand that after such dispensers as heretofore known are fully assembled, and are then shipped or otherwise transported to purchasers/users, it is not uncommon for some of the stored liquid to leak outwardly, beyond the seal, even where the amount of force normally required to open the sealing valve for dispensing of stored liquid is considerable. This is understood to occur because the final assembly of the liquid-holding container to the applicator assembly causes an overpressure condition within the dispenser/applicator interior and, as a function of (for example) the characteristics of the stored liquid, this overpressure condition can drive liquid through the closed valve and thereby cause undesired liquid leakage before the dispenser even arrives at the retailer or is purchased by an ultimate user. For many liquids intended to be dispersed using the inventive applicator herein shown and described, the second level seal is advantageously sufficient to avoid leakage even in the face of such an overpressure condition.

Nevertheless, there are some liquids for which, primarily as a function of the characteristics of the liquid, even the enhanced second level seal (FIG. 5) will prove insufficient to prevent such leakage under all conditions. For those liquids, and/or conditions, the present invention provides an additional improvement over prior art constructions by allowing the dispenser to be "burped" to alleviate the initial post-assembly overpressure condition—i.e. by inwardly or proximally depressing, after completion of assembly or manufacture of the dispenser 60, the cover member 70 (and, thereby, the shuttle member 30) to displace the shuttle member from its first position (FIG. 5) to its second position (FIG. 4) (or, as shown in FIG. 6, momentarily beyond its second position), in which second position the normal return urgency of spring 46 to maintain the shuttle in its second position is sufficient to positively prevent liquid leakage through the applicator valve during transport, reorientations and otherwise prior to or between liquid-dispensing uses of the unit 60.

While there have been shown, described and pointed out fundamental novel features of the invention as applied to preferred embodiments thereof, it will be understood that various omissions and substitutions and changes in the form and details of the structures shown and described, and in their operation and use, may be made by those skilled in the art without departing from the spirit of the invention. Moreover, it should be recognized that structures and devices shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A liquid dispenser, comprising:

a housing defining a housing interior and a longitudinal axis and an inlet proximate an axially proximal end of the housing through which a stored liquid is receivable in the housing interior and an outlet proximate an axially distal end of the housing through which the stored liquid is selectively dispensable from the housing interior;

a shuttle movable axially within the housing between distal and proximal limits of travel that include a first position defining the distal limit and a second position proximally spaced from the distal limit and distally spaced from the proximal limit, said shuttle having a frustoconical control surface;

a liquid-passage valve member in the housing interior and disposed (i) for contact with the shuttle control surface uninterruptedly between said first and second positions of the shuttle to close the housing interior against flow of the stored liquid between the inlet and outlet of the housing in both the first and second positions of the shuttle and (ii) for spaced apart relation to the shuttle control surface between the second position and the proximal limit of travel of the shuttle to define a liquid flow passage through which stored liquid can flow between the inlet and outlet of the housing;

a spring extending axially in said housing, between said shuttle and said housing proximate the housing proximal end, for normally urging the shuttle toward said housing distal end with a spring force of a first magnitude selected (i) to normally maintain the shuttle, absent application to the shuttle of an external proximally-directed force, in said second position in which flow of stored liquid from the housing inlet to the housing outlet is prevented by said contact of the liquid-passage control member with the shuttle control surface to close the liquid flow passage, (ii) to accommodate proximally-directed travel of the shuttle against the urgency of the spring from said second position to said proximal limit of travel in response to application to the shuttle of an external proximally-directed force to space apart the valve member and shuttle control surface and thereby open the liquid flow passage to enable flow of stored liquid through said liquid flow passage from the housing inlet to the housing outlet for discharge through the housing outlet, and (iii) to return the shuttle from said proximal limit to the second position and thereby reclose the liquid flow passage when the application to the shuttle of the external proximally-directed force is terminated; and a locking feature defined on the shuttle control surface for releasable engagement with the valve member at said first position distal limit of travel of the shuttle and configured to retain said releasable engagement and thereby securely maintain closure of the liquid flow passage until an external proximally-directed force of a second magnitude greater than the first magnitude is applied to the shuttle to release said engagement of the valve member and locking feature and effect proximally-directed travel of the shuttle from the first position distal limit to the second position of the shuttle;

the spring force first magnitude being insufficient to cause the shuttle to move, under the urgency of the spring, distally beyond the second position to the first position for releasable engagement of the valve member and the locking feature, so that said movement of the shuttle member from the second position to the first position can be effected only by application to the shuttle of an external proximally-directed force of the second magnitude.

2. A liquid dispenser in accordance with claim 1, further comprising a liquid storage reservoir secured proximate the proximal end of the housing for retaining a supply of liquid for dispensing through the housing distal end.

3. A liquid dispenser in accordance with claim 1, further comprising a cover member secured to the housing distal end, the cover member comprising an application surface through which liquid dispensed from the housing distal end is selectively applicable to a workpiece.

4. A liquid dispenser in accordance with claim 3, said cover member comprising a plurality of bores defined through the cover member through which stored liquid dispensed from the housing distal end travels onto an exterior surface of the cover member for application to a workpiece.

5. A liquid dispenser in accordance with claim 4, said cover member further comprising a plurality of lands projecting outwardly from the exterior surface for abutting contact with a workpiece as stored liquid is selectively applied to the workpiece.

6. A liquid dispenser in accordance with claim 1, wherein said valve member comprises an engagement edge and said locking feature comprises a discontinuity defined about the control surface of the shuttle for releasable engagement of the valve member engagement edge with said discontinuity at said first position distal limit of travel of the shuttle.

7. A liquid dispenser in accordance with claim 6, wherein said valve member engagement edge comprises a radially-inwardly extending corner tip for contact with the shuttle control surface in and between said first and second positions of the shuttle.

8. A liquid dispenser in accordance with claim 6, wherein at least one of said valve member engagement edge and said shuttle control surface is formed of a material that is resiliently deformable in response to engagement of said valve member engagement edge and said shuttle control surface at and proximate said first position of the shuttle.

9. A liquid dispenser in accordance with claim 6, wherein said shuttle control surface comprises a first segment having a first radially-varying contour and a second segment having a second radially-varying contour, and wherein said discontinuity is defined at an intersection of said first and second segments.

10. A liquid dispenser in accordance with claim 9, wherein each of said first and second segments defines a frustoconical surface.

* * * * *